US009052155B2

(12) United States Patent
Fluhr et al.

(10) Patent No.: US 9,052,155 B2
(45) Date of Patent: Jun. 9, 2015

(54) FIREARM

(75) Inventors: Norbert Fluhr, Oberndorf (DE); Johannes Bantle, Boesingen (DE); Wolfgang Wittendorfer, Fluorn-Winzeln (DE); Daniel Kohler, Oberndorf-Boll (DE); Marc Roth, Oberndorf (DE)

(73) Assignee: HECKLER & KOCH GMBH, Oberndorf (DE)

( * ) Notice: Subject to any disclaimer, the term of this patent is extended or adjusted under 35 U.S.C. 154(b) by 0 days.

(21) Appl. No.: 14/350,822

(22) PCT Filed: Jul. 2, 2012

(86) PCT No.: PCT/EP2012/062796

§ 371 (c)(1),
(2), (4) Date: Apr. 10, 2014

(87) PCT Pub. No.: WO2013/053504

PCT Pub. Date: Apr. 18, 2013

(65) Prior Publication Data

US 2014/0245649 A1 Sep. 4, 2014

(30) Foreign Application Priority Data

Oct. 13, 2011 (DE) ..... 10 2011 084 430

(51) Int. Cl.
*F41C 23/00* (2006.01)
*F41C 23/14* (2006.01)

(52) U.S. Cl.
CPC ..... *F41C 23/14* (2013.01)

(58) Field of Classification Search
USPC ..... 42/73, 71.01, 74, 43, 69.02, 69.01; 89/154, 132
See application file for complete search history.

(56) References Cited

U.S. PATENT DOCUMENTS

| | | | |
|---|---|---|---|
| 6,651,371 | B2 | 11/2003 | Fitzpatrick et al. |
| 7,810,270 | B2 | 10/2010 | Fitzpatrick et al. |
| 2007/0089347 | A1 | 4/2007 | Webber et al. |
| 2007/0289190 | A1 | 12/2007 | Oz |
| 2008/0028662 | A1 | 2/2008 | Abraham et al. |
| 2009/0139128 | A1 | 6/2009 | Fluhr |
| 2010/0205846 | A1 | 8/2010 | Fitzpatrick et al. |
| 2010/0212205 | A1 | 8/2010 | Nill |

(Continued)

FOREIGN PATENT DOCUMENTS

| | | | |
|---|---|---|---|
| DE | 102006033259 | B4 | 7/2008 |
| EP | 2194352 | A2 | 6/2010 |

(Continued)

*Primary Examiner* — J. Woodrow Eldred
(74) *Attorney, Agent, or Firm* — Leydig, Voit & Mayer, Ltd.

(57) ABSTRACT

A firearm includes a cocking lever, a shoulder-stock receptacle and a shoulder support having a shoulder stock configured to be joined by a connector to the shoulder-stock receptacle. A shoulder-stock adjuster is configured to adjust a position of the shoulder stock relative to the shoulder-stock receptacle along an adjustment axis. A cheek rest is mounted via a bearing on the shoulder stock so as to be movable in a direction parallel to the adjustment axis. A stop is disposed on the shoulder-stock receptacle so as to limit a movement path of the cheek rest towards a front of the firearm. At a position of the cheek rest defined by the stop of the shoulder-stock receptacle, the cocking lever does not collide with the cheek rest, even in a completely retracted state.

9 Claims, 18 Drawing Sheets

(56) References Cited

U.S. PATENT DOCUMENTS

| | | | | |
|---|---|---|---|---|
| 2011/0283584 | A1* | 11/2011 | Walters | 42/73 |
| 2012/0036757 | A1 | 2/2012 | Larue | |

FOREIGN PATENT DOCUMENTS

| | | | |
|---|---|---|---|
| EP | 2224202 | A2 | 9/2010 |
| WO | WO 2008140833 | A2 | 11/2008 |

* cited by examiner

FIREARM

CROSS-REFERENCE TO PRIOR APPLICATIONS

This application is a U.S. National Phase Application under 35 U.S.C. §371 of International Application No. PCT/EP2012/062796, filed on Jul. 2, 2012, and claims benefit to German Patent Application No. DE 10 2011 084 430.9, filed on Oct. 13, 2011. The International Application was published in German on Apr. 18, 2013 as WO 2013/053504 A1 under PCT Article 21(2).

FIELD

The invention relates to a firearm having a shoulder support, comprising a shoulder stock that can be joined by means of a connector to a shoulder-stock receptacle of the firearm, also comprising a shoulder-stock adjuster to adjust the position of the shoulder stock relative to the shoulder-stock receptacle along an adjustment axis, and comprising a cheek rest.

The positional designations "below, above, rear, front, side" as set forth below refer to positional designations that apply to a firearm held in a normal shooting stance in which the barrel of the firearm runs horizontally so that a shoulder stock joined to the firearm is located "at the rear" and the muzzle of the firearm is "at the front".

BACKGROUND

German patent specification DE 10 2006 033 259 B4 discloses an adjustable shoulder support that allows the position of a shoulder support surface facing towards the rear to be adjusted relative to the shoulder-stock receptacle of a weapon. As a part of the shoulder stock, the cheek rest used with this shoulder support can be adjusted, together with the shoulder stock, along the adjustment axis. Therefore, depending on the adjustment position of the shoulder stock, the cheek of a marksman will be in contact with different sections of the cheek rest.

U.S. Pat. No. 6,651,371 B2 (see FIG. 9) is an adjustable shoulder support that makes use of a cheek rest that is stationary with respect to the shoulder-stock receptacle of the firearm.

U.S. Pat. Appln. No. 2010/0205846 A1 and U.S. Pat. No. 7,810,270 B2 disclose adjustable shoulder supports in which the cheek rest is joined to the shoulder-stock receptacle of the firearm. In the shoulder support known from U.S. Pat. Appln. No. 2010/0205846 A1, a plurality of fastening points makes it possible to fasten the cheek rest in different relative positions in the lengthwise direction of the cheek rest. In the shoulder support known from U.S. Pat. No. 7,810,270 B2, a plurality of fastening points makes it possible to fasten the cheek rest in different slanted positions.

U.S. Pat. Appln. No. 2007/0289190 A1 discloses a shoulder support for a firearm, comprising a cheek rest that can be moved relative to the shoulder support in the lengthwise direction of the weapon and in the vertical direction, another firearm with an adjustable cheek rest is disclosed in U.S. Pat. Appln. No. 2008/0028662.

SUMMARY

In an embodiment, the present invention provides a firearm having a cocking lever, a shoulder-stock receptacle and a shoulder support having a shoulder stock configured to be joined by a connector to the shoulder-stock receptacle. A shoulder-stock adjuster is configured to adjust a position of the shoulder stock relative to the shoulder-stock receptacle along an adjustment axis. A cheek rest is mounted via a bearing on the shoulder stock so as to be movable in a direction parallel to the adjustment axis. A stop is disposed on the shoulder-stock receptacle so as to limit a movement path of the cheek rest towards a front of the firearm. At a position of the cheek rest defined by the stop of the shoulder-stock receptacle, the cocking lever does not collide with the cheek rest, even in a completely retracted state.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
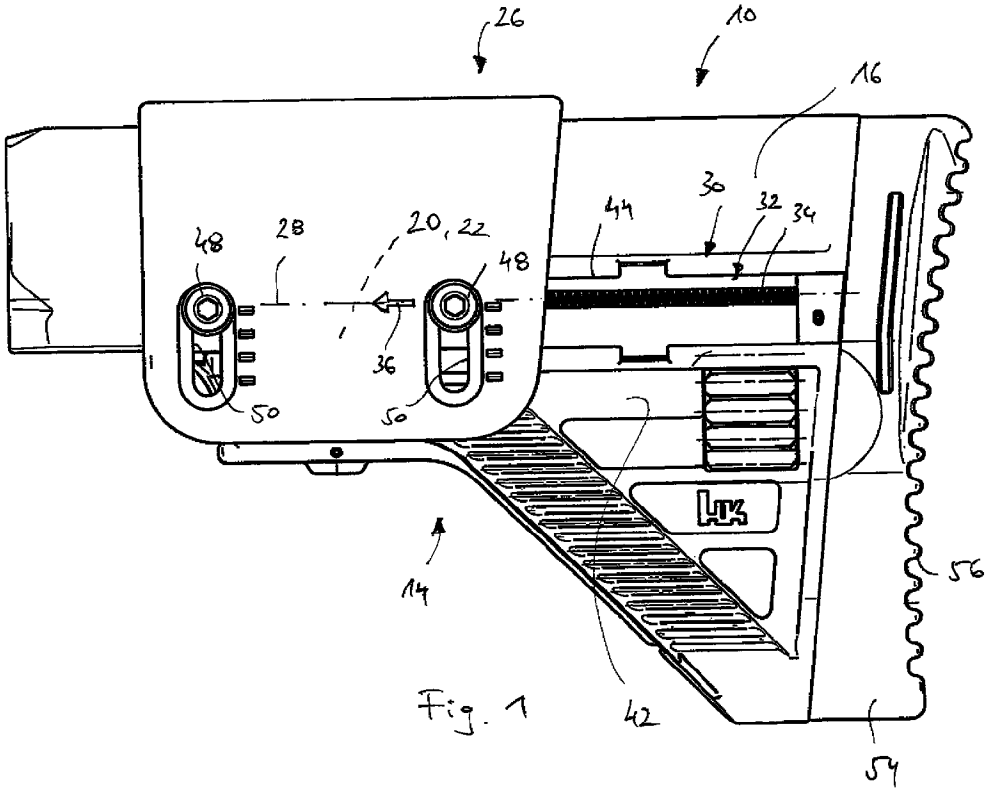
FIG. 1 a side view of a first embodiment of a shoulder support.

It has been found in the present invention that, especially when it comes to cheek rests whose height or slant can be adjusted, certain firearms entail the problem that the rear end of the cocking lever, which is moved towards the rear in order to cock the firearm, can collide with the space occupied by the cheek rest when it has been moved into a high position. This scenario occurs especially with the use of a telescopic sight, which is arranged relatively far towards the front with respect to the lengthwise direction of the firearm, so that the cheek rest also has to be positioned relatively far towards the front in order to allow the marksman to establish a suitable distance between his eye and the eyepiece of the telescopic sight. With such a configuration, it would be extremely impractical to have to remove or lower the cheek rest before every manual cocking procedure. The integration of the cheek rest into the shoulder stock as is known from the state of the art (which allows the cheek rest to be moved towards the rear along with the shoulder stock), however, is not ideal from an ergonomic standpoint since here, depending on the position of the shoulder stock, the cheek of a marksman comes to rest on or comes into contact with different sections of the cheek rest, and in a very time-consuming manner, the marksman has to search every time for the ideal distance between his eye and the eyepiece of the telescopic sight.

In an embodiment, the present invention provides a shoulder support that allows a simple and ergonomically comfortable operation of a firearm.

In an embodiment, the cheek rest is mounted by means of a bearing on the shoulder stock so as to be movable in the direction parallel to the adjustment axis.

The firearm with the shoulder support according to an embodiment of the invention allows an easy shifting of the cheek rest so that, whenever necessary, the cheek rest can avoid a space-filling cocking lever. Moreover, the movable mounting of the cheek rest on the shoulder stock fundamentally makes it possible to move the cheek rest together with the shoulder stock but, whenever necessary, it can also be movable relative to the shoulder stock, so that the position of the cheek rest in the direction parallel to the adjustment axis can be set along the adjustment axis independently of the position of the shoulder stock.

Therefore, the firearm with the shoulder support according to an embodiment of the invention allows a simple and ergonomically comfortable operation of a firearm.

In a preferred embodiment of the invention, a force-application device is provided to apply a force onto the cheek rest, said force being oriented parallel to the adjustment axis. The force-application device has the advantage that force is applied to the cheek rest along the bearing in a defined direction, so that the cheek rest can be held in a basic position that is described below. The maximum force exerted by the force-application device should preferably be dimensioned in such a way that a marksman can counteract this force manually. In an embodiment, the force-application device is especially a spring.

Preferably, the force exerted by the force-application device onto the cheek rest is oriented towards the front. As a result, the cheek rest in its basic position is as close as possible to the firearm.

In an embodiment, a stop is provided to limit the movement path of the cheek rest on the shoulder-stock receptacle. The stop makes it possible to define a basic position of the cheek rest relative to the shoulder-stock receptacle and thus relative to the firearm.

According to an embodiment of the invention, it is provided that the stop is stationary with respect to the shoulder-stock receptacle, so that a shoulder support with a very simple structure can be created.

In an alternative embodiment, it is provided that the position of the stop relative to the shoulder-stock receptacle can be adjusted in a direction parallel to the adjustment axis (for instance, by means of a stop that runs movably in a linear guide and that can be secured in place by means of a locking bolt or the like). This adjustment capability makes it possible to change the basic position of the cheek rest.

Preferably, the bearing comprises a linear guide with a guide rail and with a carriage that runs in or on the guide rail. Thanks to this linear guide, the cheek rest can run easily and reliably on the shoulder stock. It is conceivable to provide a stationary carriage and a movable guide rail, although it is preferable for the guide rail to be stationary relative to the shoulder stock and for the carriage to be movable. Accordingly, it is preferred for the cheek rest to be joined to the carriage.

For purposes of further improving the ergonomics of the shoulder support, it is proposed that a cheek-rest adjuster be provided in order to set the height and/or slant of the cheek rest.

Finally, it is preferred for the bearing to be arranged on at least one side surface of the shoulder stock, so that a surface of the shoulder stock facing upwards can be configured so as to be at least essentially smooth-faced, in other words, free of bearing components.

It is possible for the bearing to be arranged only on one side surface of the shoulder stock and for the cheek rest—starting from a side surface of the shoulder stock—to extend over the top of the shoulder stock and finally to overlap a second side surface that faces away from the first side surface.

However, it is also possible to provide a cheek rest that only overlaps one side surface of the shoulder stock and only the top of the shoulder stock or else only part of the top of the shoulder stock.

Finally, it is possible to provide several bearings so that a cheek rest can be joined to one of the bearings as desired. This can be advantageous, for instance, when a firearm is to be converted from right-handed operation to left-handed operation or vice-versa.

Figure 12:
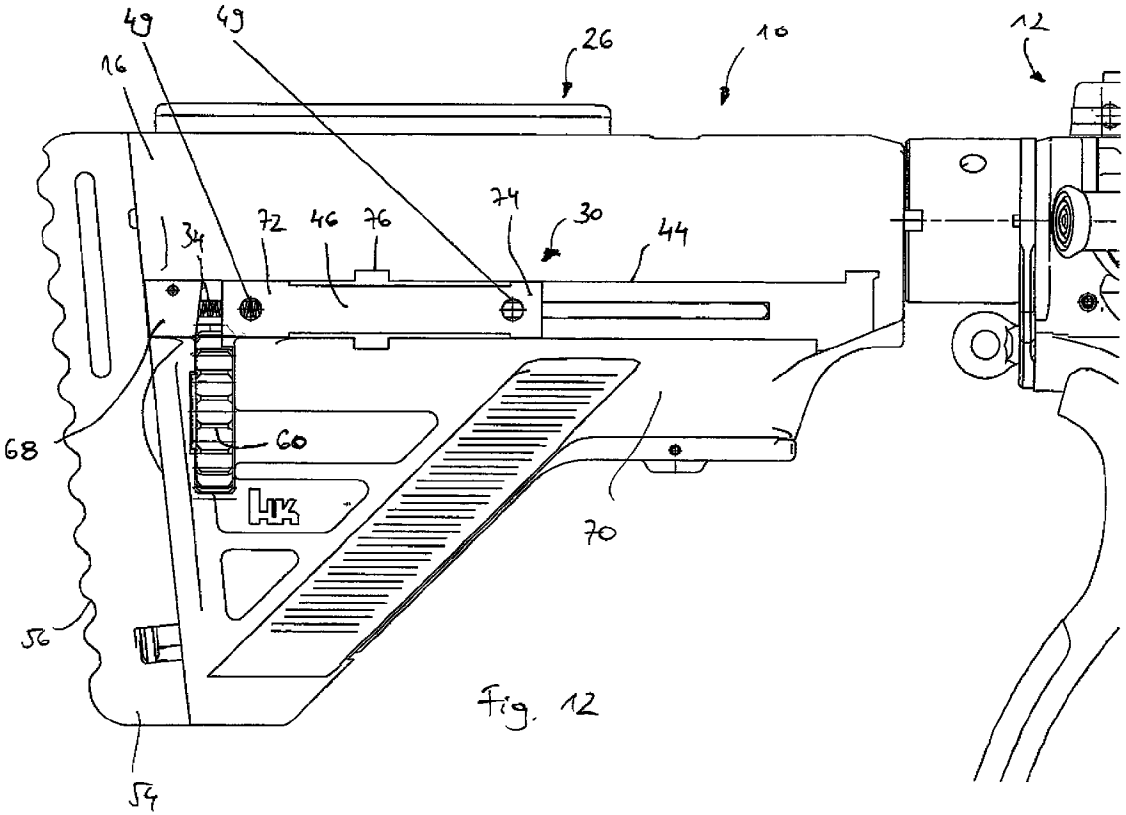
FIG. 12 a side view of the shoulder support according to FIG. 11, as seen from the opposite direction in comparison to FIG. 11, with a cheek rest mounted on the left-hand side.
Figure 13:
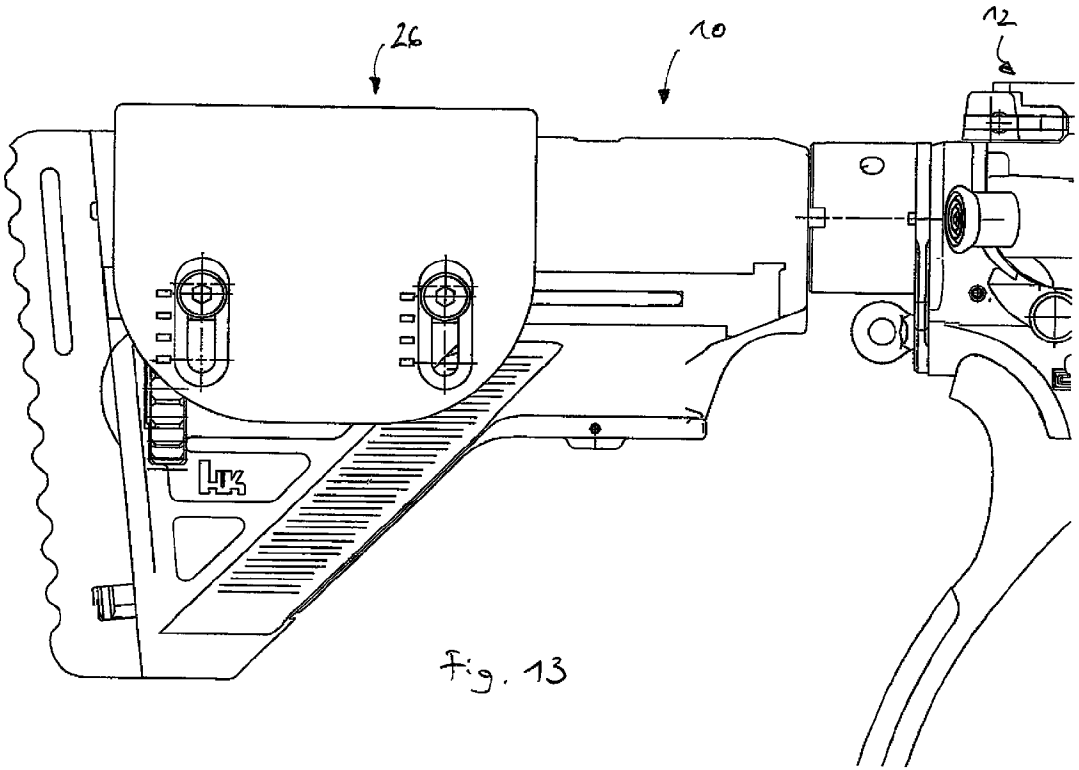
FIG. 13 a side view corresponding to FIG. 12, with a cheek rest mounted on the right-hand side.
Figure 14:
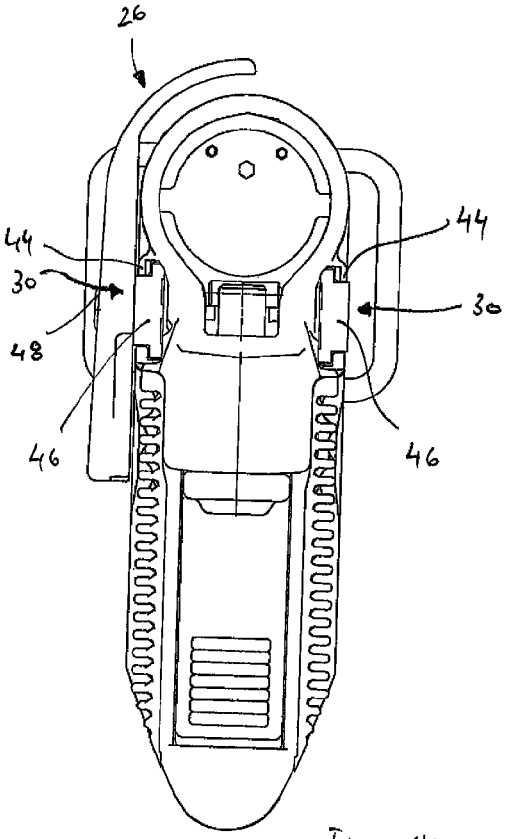
FIG. 14 a sectional view of the shoulder support according to FIG. 11 corresponding to FIG. 9.

An embodiment of a shoulder support is depicted in the drawing and designated in its entirety by the reference numeral 10. The shoulder support 10 forms the rear part of a firearm 12 (FIG. 12) when it is joined to said firearm.

The shoulder support 10 comprises a shoulder stock 14 having a housing 16 that can be slid onto a shoulder-stock receptacle 18 of the firearm 12. The shoulder stock 14 is joined to the shoulder-stock receptacle 18 by means of a connector 20 that is known from German patent specification DE 10 2006 033 259 B4. By means of an adjuster 22, likewise known from DE 10 2006 033 259 B4, the position of the shoulder stock 14 relative to the shoulder-stock receptacle 18 can be adjusted along an adjustment axis 24 (see FIGS. 3 and 4). Regarding the structure and mode of operation of the connector 20 and of the adjuster 22, reference is hereby made to the disclosure of German patent specification DE 10 2006 033 259 B4.

The shoulder stock 14 comprises a cheek rest 26 that is provided separately from the housing 16 and that can be moved along a movement axis 28 relative to the housing 16 of the shoulder stock 14. The movement axis 28 and the adjustment axis 24 are parallel to each other or at least essentially parallel to each other.

Figure 9:
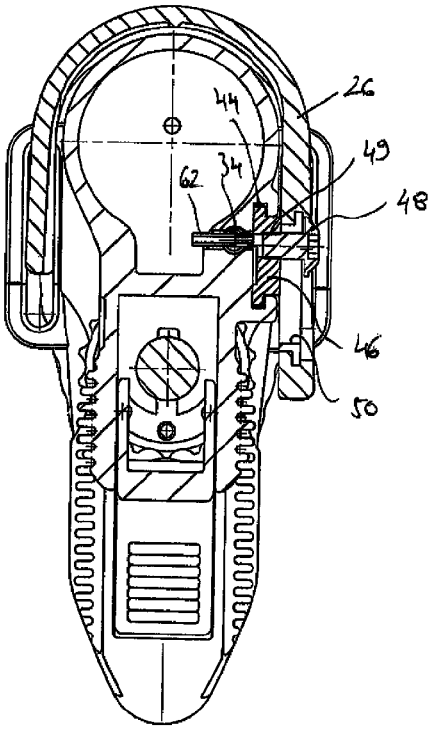
FIG. 9 a sectional view of the shoulder support according to FIG. 1, along a vertical sectional plane designated by IX-IX in FIG. 3.

The movement axis 28 is defined by a bearing that is arranged on the housing 16 of the shoulder stock 14 and that is described below in greater detail making reference to FIGS. 9 and 10.

The shoulder support 10 comprises a force-application device 32 which is particularly configured in the form of a compression spring 34. The force-application device 32 generates a force 36 that is especially directed towards the front (see FIG. 1). Preferably, the direction of the force 36 is flush with the movement axis 28.

Figure 2:
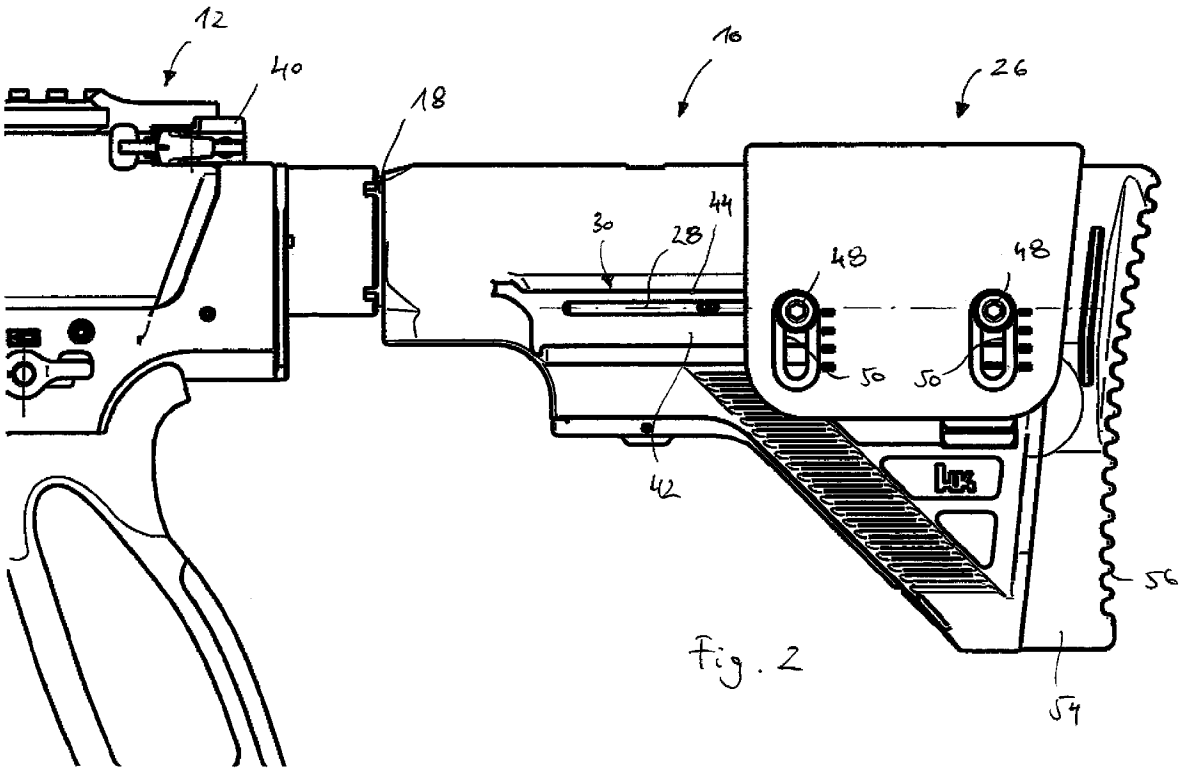
FIG. 2 a side view of the shoulder support when it is joined to a firearm, whereby the shoulder support takes on a front position.

The bearing 30 makes it possible to move the cheek rest 26 along the movement axis 28 against the action of the compression spring 34 out of its front position shown in FIG. 1 and then into a rear position shown in FIG. 2. In the position of the cheek rest 26 shown in FIG. 2, the movement path of the cheek rest 26 towards the front is limited by a stop 38 formed on the shoulder-stock receptacle 18 (see FIG. 10). The stop 38 causes the cheek rest 26—in spite of the action of the compression spring 34—to assume a position shown in FIG. 2 that is at the rear relative to the shoulder stock 14, and not the position at the front shown in FIG. 2.

Figure 4:
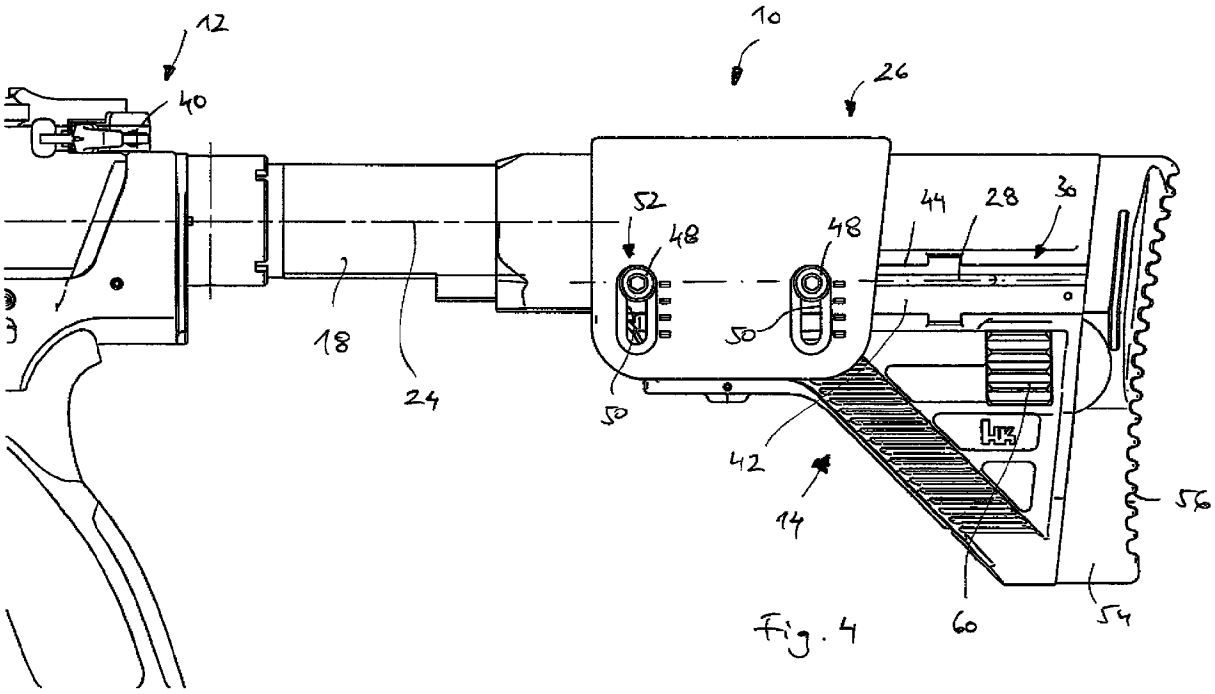
FIG. 4 a view corresponding to FIG. 2, whereby the shoulder support assumes an extended position, whereby a cheek rest assumes a lowered position and whereby a rear shoulder-stock section rests against a housing of the shoulder stock.

However, when the shoulder stock 14 is changed from the front position according to FIG. 2 into an extended position according to FIG. 4, the compression spring 34 also causes the cheek rest 26 not to be moved together with the shoulder stock 14 into a position further towards the rear, but rather to remain in the same position relative to the shoulder-stock receptacle 18.

Figure 3:
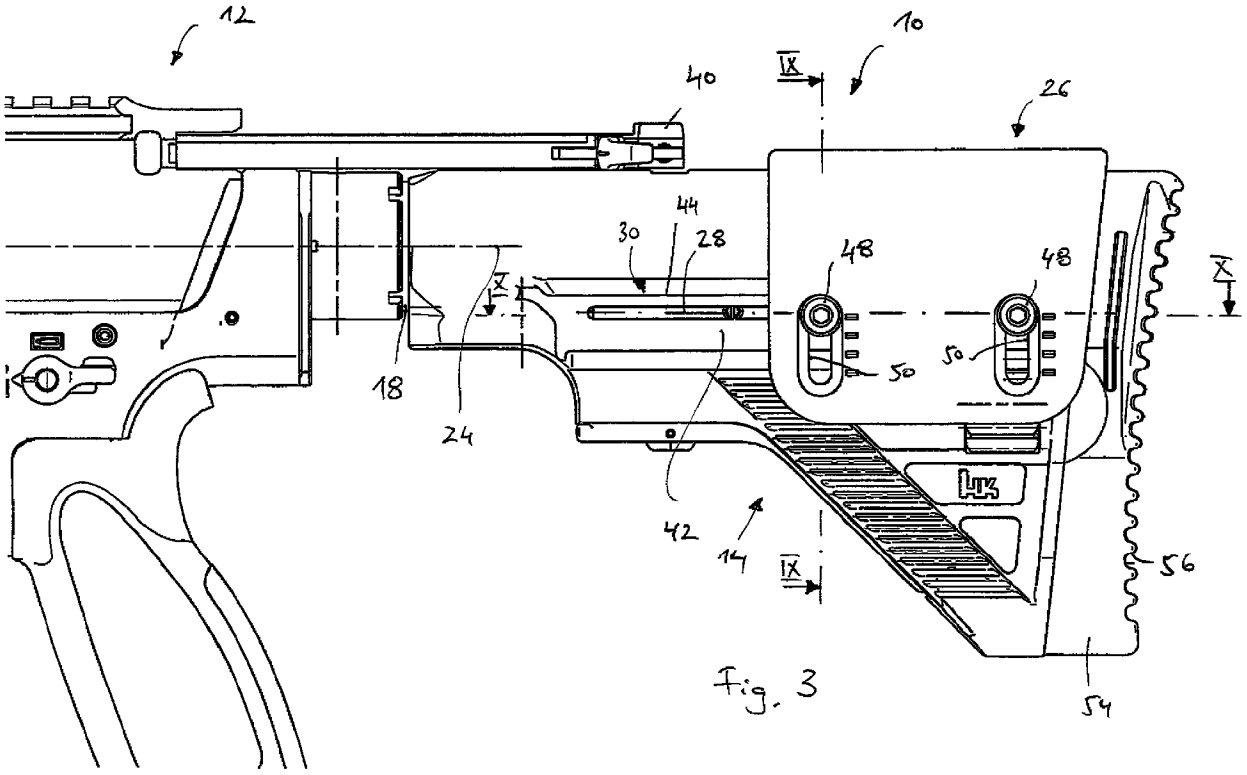
FIG. 3 a view corresponding to FIG. 2 when the cocking lever of the firearm is actuated.

The position of the cheek rest 26 shown in FIGS. 2 to 4 and determined by the stop 38 of the shoulder-stock receptacle 18 is configured in such a way that a cocking lever 40 of the firearm 12 (see FIG. 2) does not collide with the cheek rest 26, even in the completely retracted state (see FIG. 3).

The bearing 30 comprises a guide rail 44 that is preferably arranged on a side surface 42 of the shoulder stock 14 and that serves to guide a slide of the carriage 46 (see FIG. 9) that can be slid along the guide rail 44.

The cheek rest 26 is preferably detachably joined to the carriage 46. In the embodiment shown, there are two fastening screws 48 that pass through the slots 50 formed in the cheek rest 26 and that are screwed into the threaded sections 49 of the carriage 46.

Figure 5:
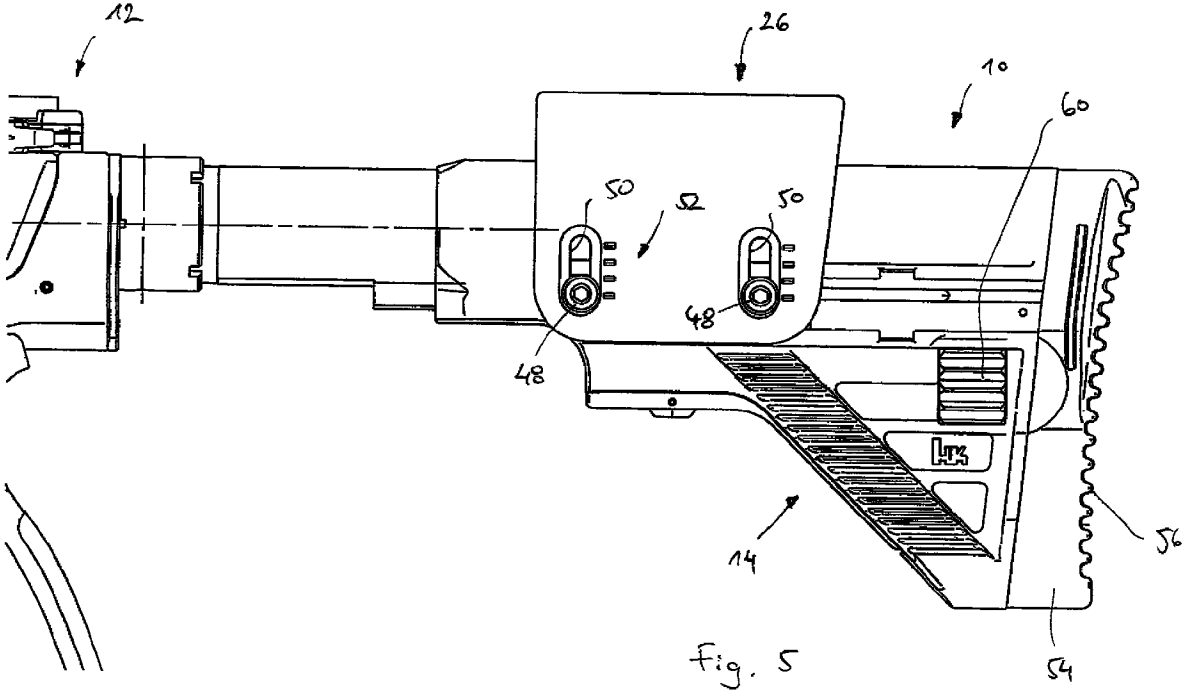
FIG. 5 a view corresponding to FIG. 4, whereby the cheek rest assumes a raised position FIG. 6 a view corresponding to FIG. 4, whereby the cheek rest assumes a position slanted towards the rear.

The fastening screws 48, the threaded sections 49 and the slots 50 together form a cheek-rest adjuster 52 that allows the height and the slant of the cheek rest 26 to be adjusted relative to carriage 46. Thus, FIG. 4 shows the cheek rest 26 in a lowered position, FIG. 5 shows it in a raised position, FIG. 6 shows it in a position slanted towards the rear, and FIG. 7 shows it in a position slanted towards the front.

The shoulder stock 14 has a rear shoulder-support section 54 whose rear end has a profiled shoulder support surface 56.

Figure 6:
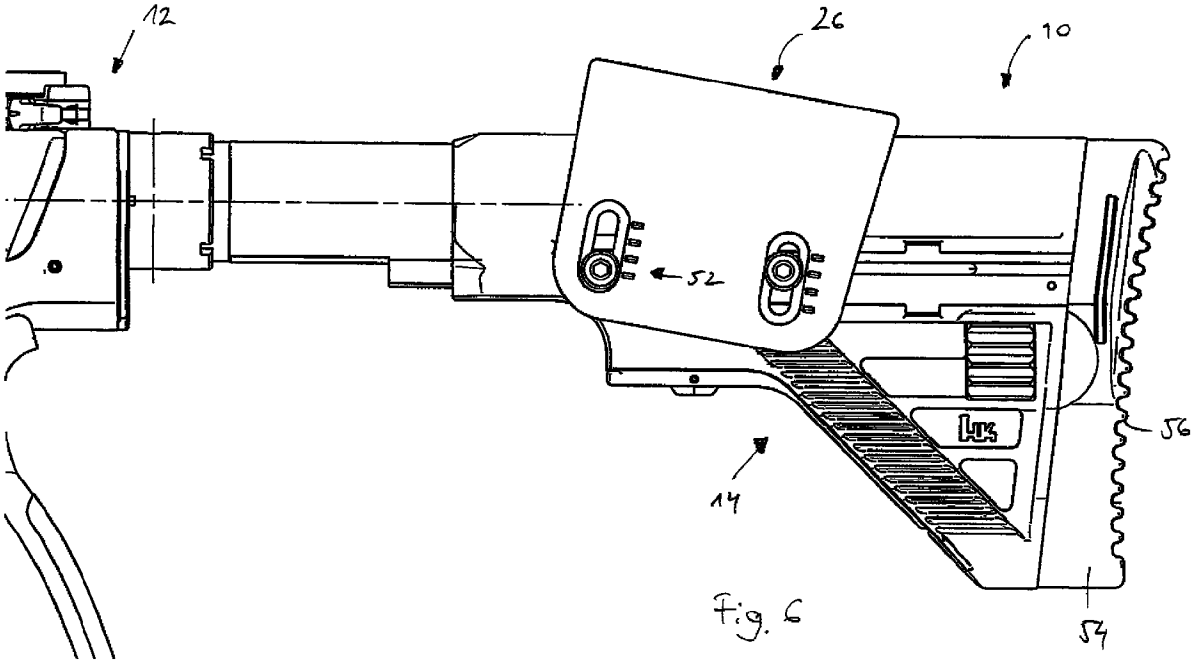
Figure 7:
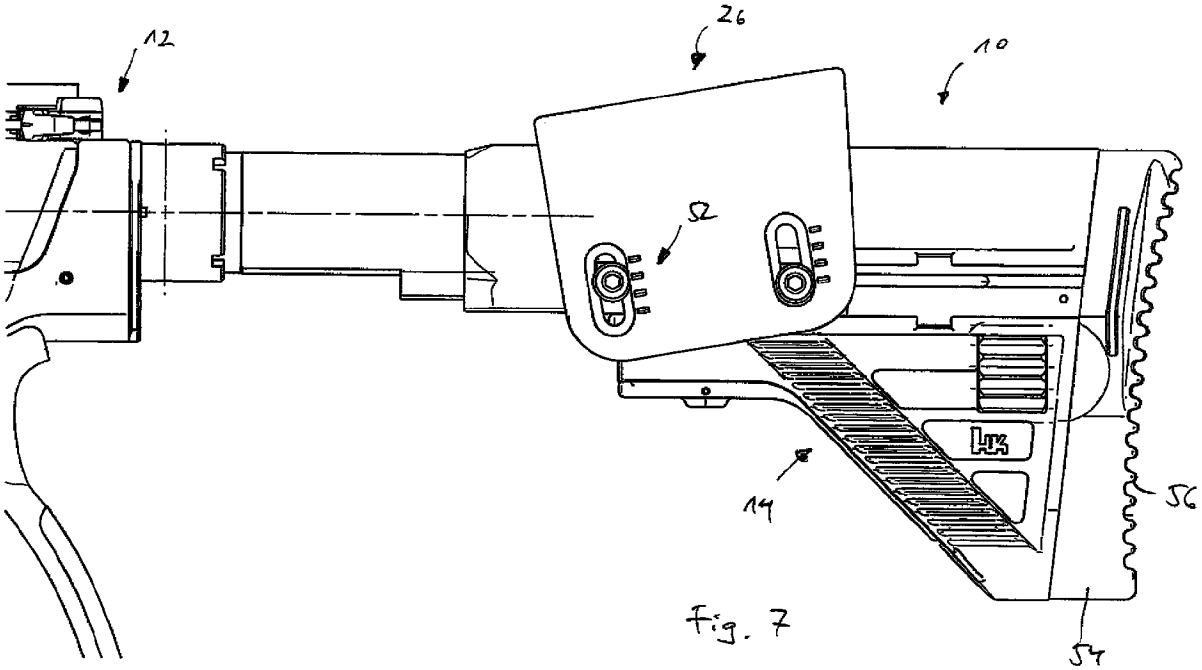
FIG. 7 a view corresponding to FIG. 4, whereby the cheek rest assumes a position slanted towards the front.
Figure 8:
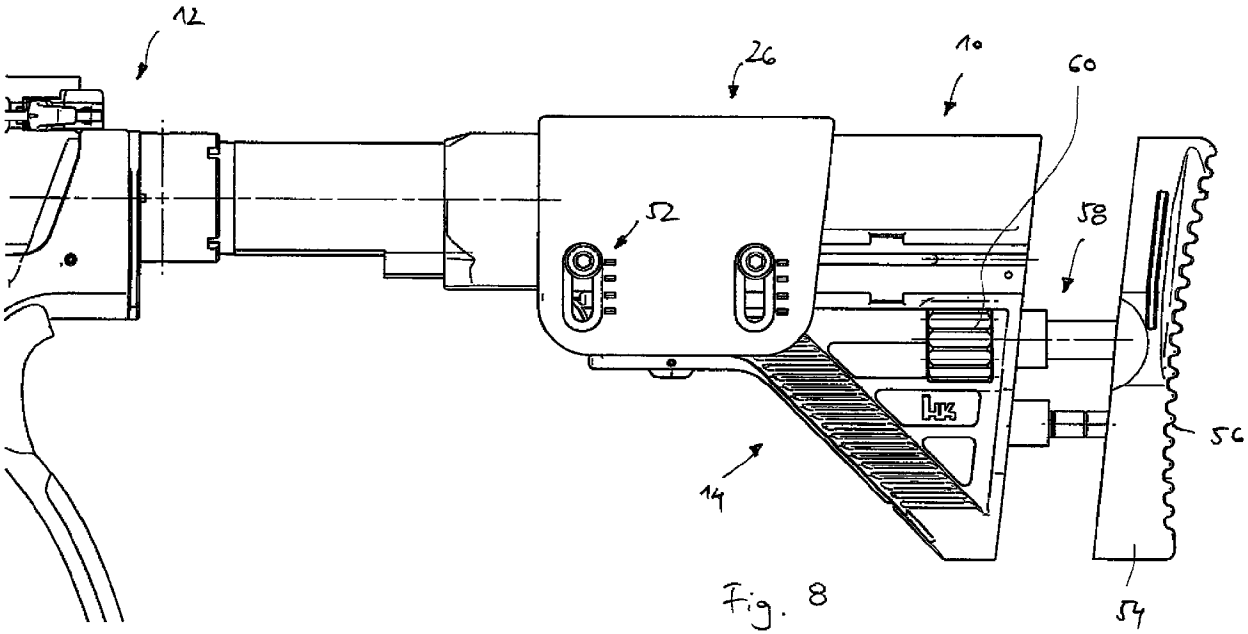
FIG. 8 a view corresponding to FIG. 4, whereby the rear shoulder-support section is at a distance from the housing of the shoulder stock.

The shoulder-support section 54 can be adjusted relative to the housing 16 of the shoulder stock 14 in a direction parallel to the adjustment axis 24 (see, for instance, FIGS. 4 and 6). For this purpose, there is a fine adjuster 58 (which is generally known and therefore not elaborated upon here) that can be actuated by means of an actuator element 60, for example, a knurled knob.

Particular reference will be made below to FIGS. 9 and 10. The carriage 46 has a stop element 62 that extends crosswise to the movement axis 28, and the front end of the compression spring 34 applies force to the rear of this stop element 62. The stop element 62 interacts with the stop 38 of the shoulder-stock receptacle 18 when the cheek rest 26 is in its front position. In order for the stop element 62 to be able to move along the movement axis 28 of the carriage 46, the shoulder-stock receptacle 18 has a slot 64.

Figure 10:
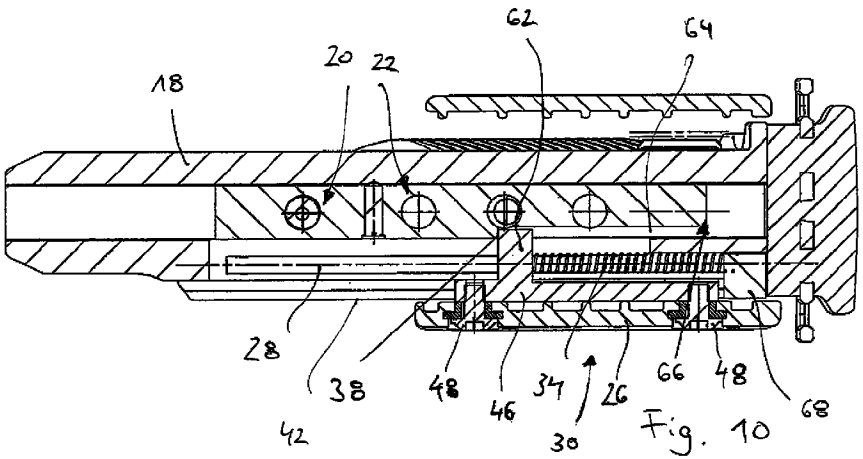
FIG. 10 a sectional view of the shoulder support according to FIG. 1, along a horizontal sectional plane designated by X-X in FIG. 3.
Figure 11:
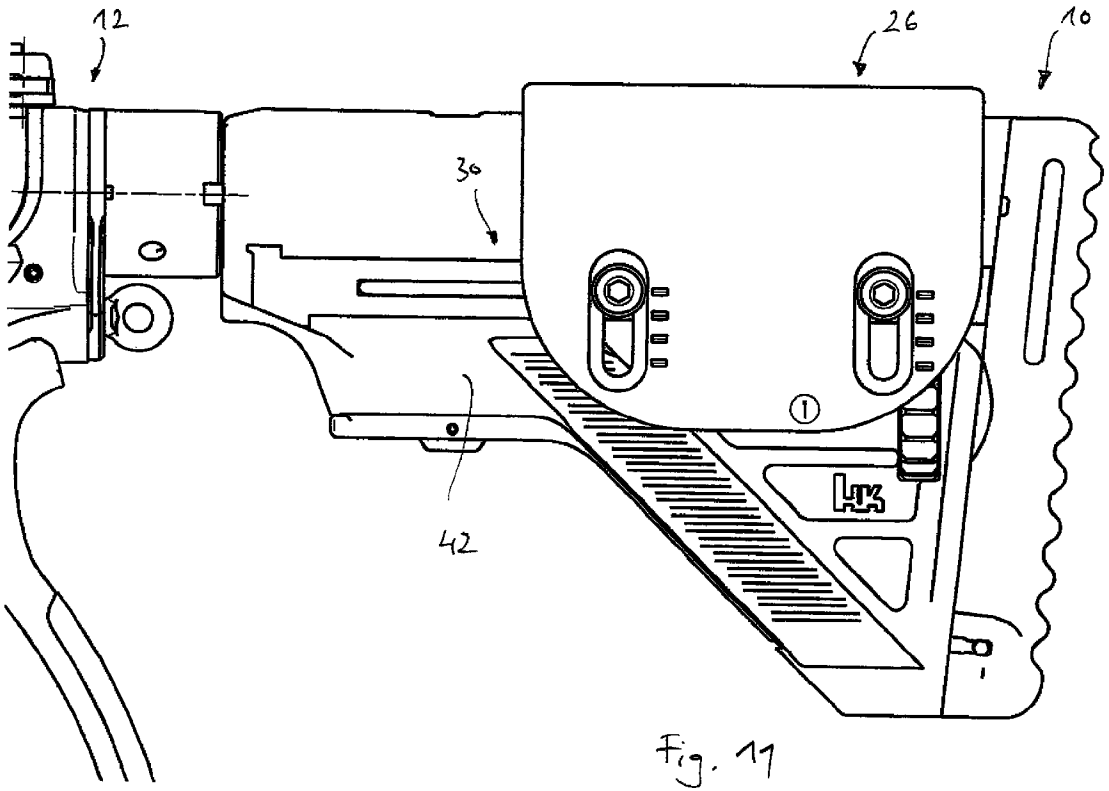
FIG. 11 a view corresponding to FIG. 2 showing another embodiment of a shoulder support.

The reference arrow 66 in FIG. 10 designates an alternative arrangement of the stop 38. This arrangement has the advantage that the slot 64 can be dispensed with and existent shoulder-stock receptacles 18 can be used without the need for any further adaptation. In this case, instead of a compression spring 34, a tension spring is employed that exerts a forward-directed tension onto the carriage 46.

In the embodiment shown in the drawing, the rear end of the compression spring 34 is supported on a support element 68.

The structure and the mode of operation of a shoulder support 10 described below making reference to FIGS. 11 to 18 correspond to the structure and the mode of operation of the shoulder support 10 described above making reference to FIGS. 1 to 10. Only the differences from the shoulder support already described above will be explained below. For the rest, reference is hereby made to the description above.

In the case of the shoulder support 10 according to FIGS. 11 to 18, a cheek rest 26 can be mounted on side surfaces 42 (see FIG. 11) and 70 (see FIG. 12) that face away from each other. For this purpose, the shoulder support 10 has a bearing 30 on each of the side surfaces 42 and 70. This allows the cheek rest 26 to be fastened on the left-hand side (see FIGS. 11 and 12) as well as on the right-hand side (see FIG. 13).

In order to mount the carriage 46 of the bearing 30, the actuating element 60 can be employed to move the rear shoulder-support section 54 from its retracted position, shown in FIG. 1, into an extended position (see FIG. 8) so that, after the support element 68 has been removed, the space created between the shoulder-support section 54 and the housing 16 can be utilized to bring a front end 74 of the carriage 46 sideways into a widening 76 of the guide rail 44 while, at the same time, a rear end 72 of the carriage 46 is inserted into the guide rail 44. Subsequently, the carriage 46 is pushed towards the front, the compression spring 34 is positioned along the movement axis 28 of the bearing 30, and the guide rail 44 is closed towards the rear by the support element 68.

It goes without saying that the assembly possibility for the carriage described above also exists for the opposite side 70 of the shoulder support 10 and for the shoulder support 10 described in reference to FIGS. 1 to 10.

Figure 15:
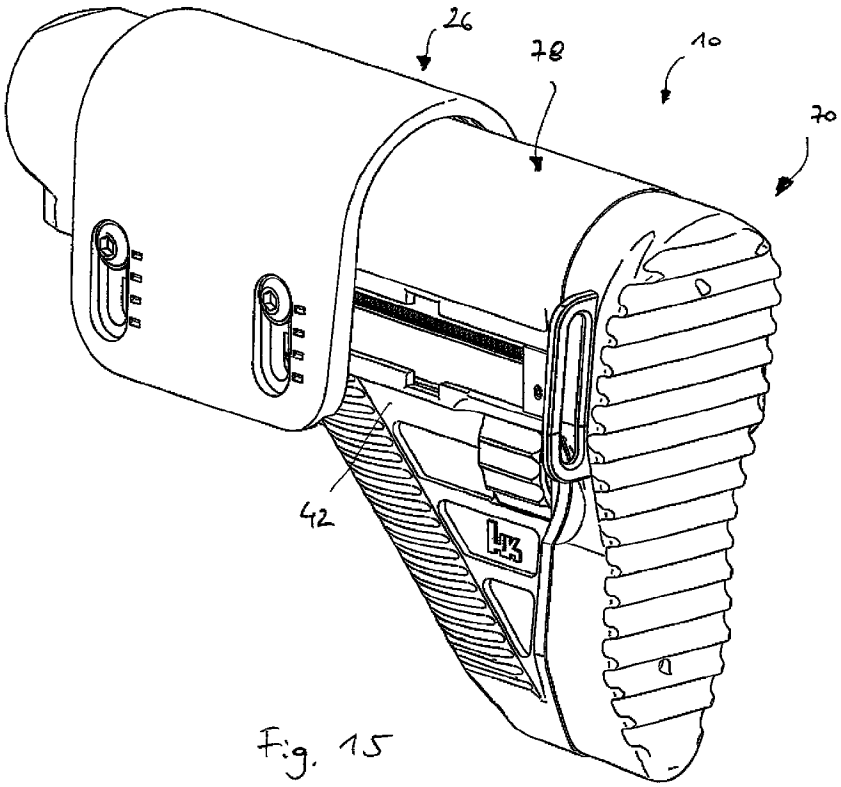
FIG. 15 a perspective view of the shoulder support according to FIG. 11, with a cheek rest on both sides.
Figure 16:
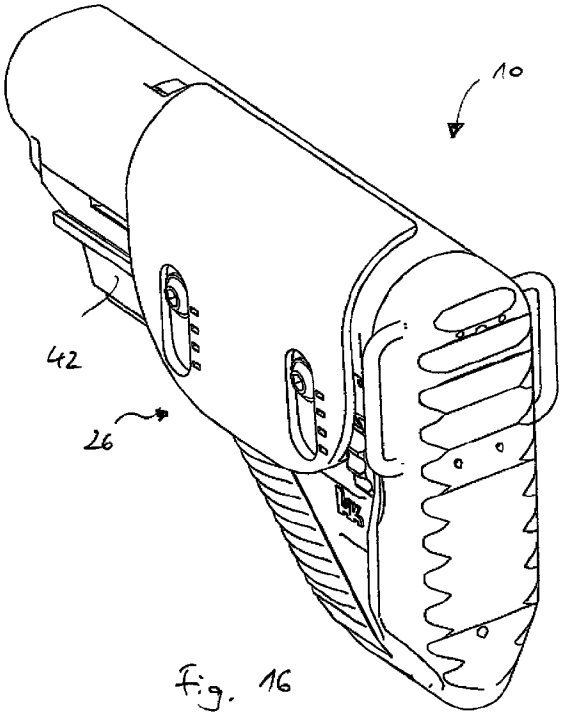
FIG. 16 a view corresponding to FIG. 15, with a cheek rest on one side.
Figure 17:
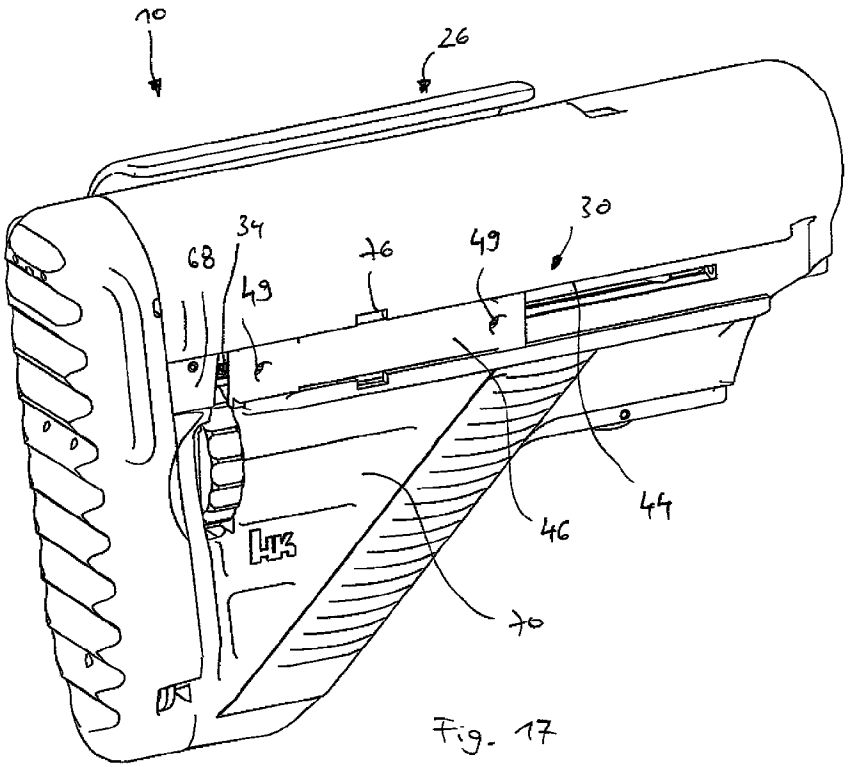
FIG. 17 a perspective view of the shoulder support according to FIG. 11, as seen from the opposite perspective in comparison to FIG. 15.

The cheek rests 26 can be, for example, cheek rests 26 as depicted in FIG. 15 which, starting from a first side surface 42, extend over the top 78 all the way to a second side surface 70 (see FIG. 15). As an alternative to this, the cheek rest 26 extends over only one of the side surfaces 42 or 70 and over only the top 78 or part of the top 78 (see FIGS. 16 and 17).

Figure 18:
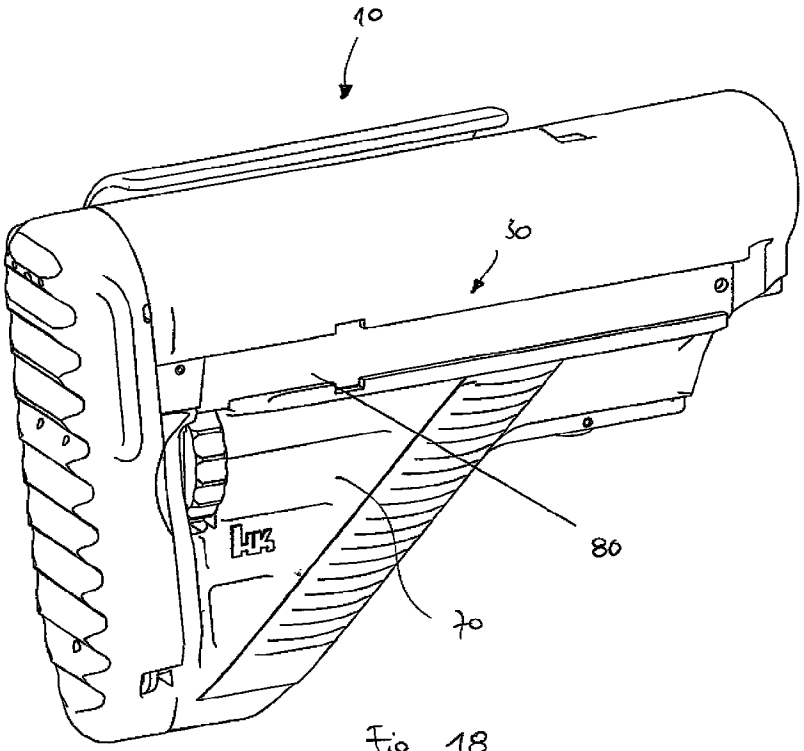
FIG. 18 a view corresponding to FIG. 17, of the installation of a shield that covers the bearing.

Especially in the case of a cheek rest 26 that covers only one side, and when only one bearing 30 is used, it can be advantageous to employ a shield that covers or fills up the guide rail 44, preferably in its entirety (see FIG. 18).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The invention claimed is:

1. A firearm, comprising:

a cocking lever movable to a completely retracted state to cock the firearm;

a shoulder-stock receptacle;

a shoulder support having a shoulder stock configured to be joined by a connector to the shoulder-stock receptacle;

a shoulder-stock adjuster configured to adjust a position of the shoulder stock relative to the shoulder-stock receptacle along an adjustment axis from a front position to an extended position;

a cheek rest mounted via a bearing on the shoulder stock so as to be movable in a direction parallel to the adjustment axis; and a stop disposed on the shoulder-stock receptacle so as to limit a movement path of the cheek rest towards a front of the firearm, wherein, at a position of the cheek rest defined by the stop of the shoulder-stock receptacle with the shoulder stock at the front position, the cocking lever does not collide with the cheek rest as the cocking lever is moved to the completely retracted state.

2. The firearm according to claim 1, further comprising a force-application device configured to apply a force onto the cheek rest, the force being oriented parallel to the adjustment axis, the stop being releasable and the bearing being arranged such that movement of the shoulder stock from the front position to the extended position results in no relative movement of the cheek rest relative to the shoulder-stock receptacle.

3. The firearm according to claim 2, wherein the force is oriented towards the front.

4. The firearm according to claim 1, wherein the stop is stationary with respect to the shoulder-stock receptacle.

5. The firearm according to claim 1, wherein a position of the stop relative to the shoulder-stock receptacle is adjustable in a direction parallel to the adjustment axis.

6. The firearm according to claim 1, wherein the bearing includes a linear guide having a guide rail and a carriage that runs in or on the guide rail.

7. The firearm according to claim 6, wherein the cheek rest is fastened to the carriage.

8. The firearm according to claim 1, further comprising a cheek-rest adjuster configured to set at least one of a height and a slant of the cheek rest.

9. The firearm according to claim 1, wherein the bearing is disposed on at least one side surface of the shoulder stock.

* * * * *